US010413463B2

(12) United States Patent
Borges De Abreu et al.

(10) Patent No.: US 10,413,463 B2
(45) Date of Patent: Sep. 17, 2019

(54) HOSPITAL BED STRUCTURE

(71) Applicants: Pablo Borges De Abreu, São Paulo (BR); João Bosco Da Silva Ananias, São Paulo (BR); Eraldo Costa Sampaio, São Paulo (BR)

(72) Inventors: Pablo Borges De Abreu, São Paulo (BR); João Bosco Da Silva Ananias, São Paulo (BR); Eraldo Costa Sampaio, São Paulo (BR)

( * ) Notice: Subject to any disclaimer, the term of this patent is extended or adjusted under 35 U.S.C. 154(b) by 185 days.

(21) Appl. No.: 15/454,023

(22) Filed: Mar. 9, 2017

(65) Prior Publication Data

US 2018/0256424 A1 Sep. 13, 2018

(51) Int. Cl.

| | |
|---|---|
| ***A61G 7/05*** | (2006.01) |
| ***A61G 7/018*** | (2006.01) |
| ***A61G 7/015*** | (2006.01) |
| ***A61G 7/00*** | (2006.01) |
| ***A61G 7/012*** | (2006.01) |

(52) U.S. Cl.

CPC ..... *A61G 7/018* (2013.01); *A61G 7/001* (2013.01); *A61G 7/012* (2013.01); *A61G 7/015* (2013.01)

(58) Field of Classification Search

CPC ..... A61G 7/05
USPC ..... 5/607–608, 610, 613, 616–619
See application file for complete search history.

(56) References Cited

U.S. PATENT DOCUMENTS

| | | | | |
|---|---|---|---|---|
| 5,125,122 | A * | 6/1992 | Chen | A61G 7/015 5/607 |
| 5,303,437 | A * | 4/1994 | Hung | A61G 7/015 5/607 |
| 5,479,665 | A | 1/1996 | Cassidy et al. | |
| 2005/0166323 | A1* | 8/2005 | Kawakami | A61G 7/001 5/610 |

FOREIGN PATENT DOCUMENTS

BR MU9001994-6 U2 2/2013

* cited by examiner

*Primary Examiner* — Fredrick C Conley
(74) *Attorney, Agent, or Firm* — Umberg Zipser LLP

(57) ABSTRACT

A hospital bed structure intended to serve as a basic structure for the assembly of hospital beds with multiple adjustments, which allows obtaining a hospital bed that can be used with a special type of mattress and which is able to carry out the multiple bed adjustments. The structure is characterized in that it is defined by four main elements, the first of which is a frame box, which has two sets of bedposts, one front and one rear; the second of which is the support frame, which is mounted on and transversely to the frame box; the third of them is the lower bed frame; and the fourth is the load cells which are mounted between bearing profiles fixed to the side of the frame box and the blocks through which the axles are passed.

5 Claims, 11 Drawing Sheets

HOSPITAL BED STRUCTURE

FIELD OF TECHNOLOGY

The following relates to hospital equipment, more specifically, hospital beds of the type which presents multiple adjustments of the inclination plane and mattress positioning.

BACKGROUND

Currently, several hospital bed models are known, which, in contrast to the beds for domestic use, incorporate mechanisms that enable the elevation of the thorax and head and also the movement of the portion that supports the patient's legs.

The mechanisms used in conventional hospital beds are provided with lever systems or screw drives, which are turned by cranks or motorized, thereby enabling the planes, on which the mattress is positioned, to be changed.

Another aspect that distinguishes conventional hospital beds from those of domestic use lies in the fact that they have structures that act as a guardrail, which can be removed or tilted and whose main function is to prevent the patient from accidentally falling out the bed during sleep or due to involuntary movements The above described hospital beds have a general design which has remained essentially unchanged since the appearance of the first models.

On Oct. 10, 2010, the aforementioned holder, from the state of the art described above filed the patent application of Utility Model MU 9001994-6, entitled "DISPOSITION INTRODUCED IN A HOSPITAL BED WITH MULTIPLE COMPUTERIZED ADJUSTMENTS", which was innovative because it presented a structure that allowed to obtain new movements.

The hospital bed proposed in the aforementioned patent application has a base, on which there is a pantographic lifting mechanism, of a second above-located base, which is also equipped with a central and also pantographic and tipping system.

Utility Model MU 9001994-6 proposed hospital bed is also provided with another double lateral tilting mechanism operated by levers with angular movement.

The above-described hospital bed mechanisms are operated by electric motor reducers, which are controlled by a computerized electro-electronic device, operating by means of a control panel, which includes buttons and function display.

The pantographs, employed in the hospital bed belonging to the recent state of the art, are operated by means of a threaded shaft interconnected to an electric motor-reducer, which enables the opening and closing thereof.

The side tilting mechanisms of the above-described hospital bed operate by means of a sequence of independent cardan shafts with perpendicular levers and furthermore have axial electric motor reducers, which are interconnected by crossbeams and supported by bearings Utility Model MU 9001994-6 illustrated and described bed represented and represents an advance over the previous hospital beds, since it allows obtaining a structure that carries out innovative movements, besides the movements already provided by older hospital beds.

In the present case, the most direct prior art is represented by Utility Model MU 9001994-6, and in this sense, despite the above mentioned advance, the holder realized that the hospital bed structure could be improved, in order mainly to simplify its design, to increase its efficiency and still to lower the cost of production.

In the case of the in the previous document described hospital bed, the use of the pantographic mechanisms and cardan shafts imparts to the project a high level of complexity, thus increasing the final cost of the hospital bed as is proposed.

SUMMARY

An aspect relates to a hospital bed structure intended to serve as a basic structure for the assembly of hospital beds with multiple adjustments, which allows obtaining a hospital bed that can be used with a special type of mattress that is the subject of a patent application of the same holder and which is capable of accompanying the multiple adjustments of the bed.

The hospital bed structure proposed by embodiments of the invention presents an innovative design which simplifies this type of equipment, making it more efficient and capable of being produced on a large scale.

Another aspect relates to a hospital bed structure of the type having multiple computerized adjustments, analogous to the model which is dealt with in Utility Model MU 9001994-6, but unlike the various pantographic mechanisms and cardan shafts it presents a substantially simpler and low cost solution.

Another aspect is to provide a hospital bed structure of the type that has multiple computerized adjustments and based on the simpler and more functional design can be produced on a large scale, so as to represent an alternative for hospitals, bringing clear benefits to the patients.

Embodiments of the hospital bed structure have a structural housing defining the command tunnel that houses the leg movement mechanisms of the structure, the mechanisms for moving the support planes, defining the lower bed frame, on which the covers are then mounted. Each of the covers is divided into right and left portion, which can describe angular movement. On the structural housing is mounted the support frame, on which is mounted the aforementioned lower bed frame, which when fully assembled constitutes the area of positioning of the mattress. Load cells are incorporated so that the patient can be weighed without having to leave the bed.

BRIEF DESCRIPTION

Some of the embodiments will be described in detail, with reference to the following figures, wherein like designations denote like members, wherein.

Figure 4:
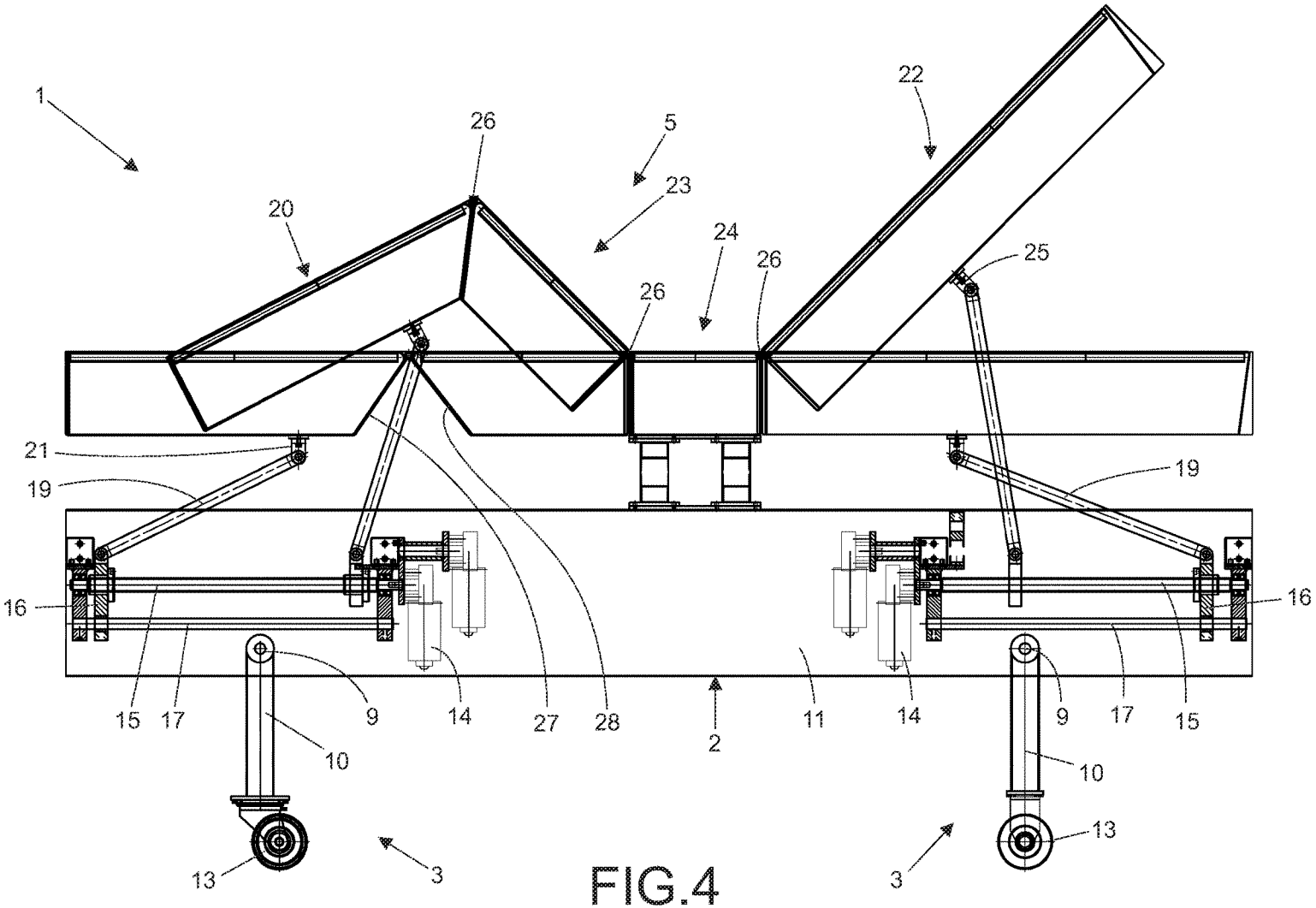
Figure 5:
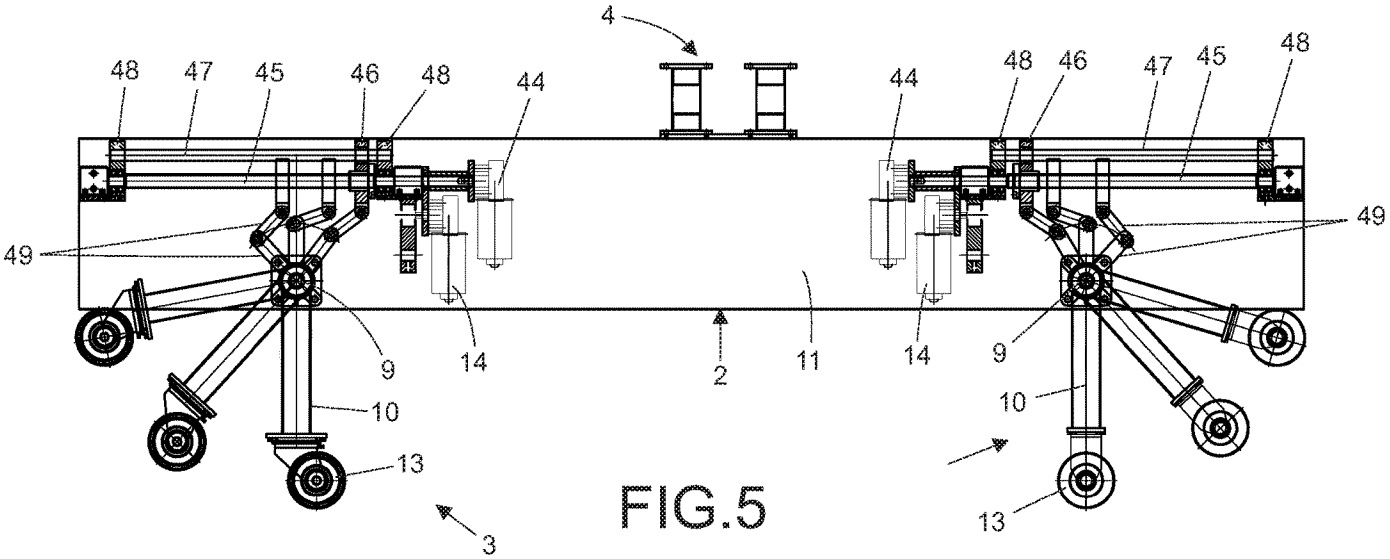
Figure 6:
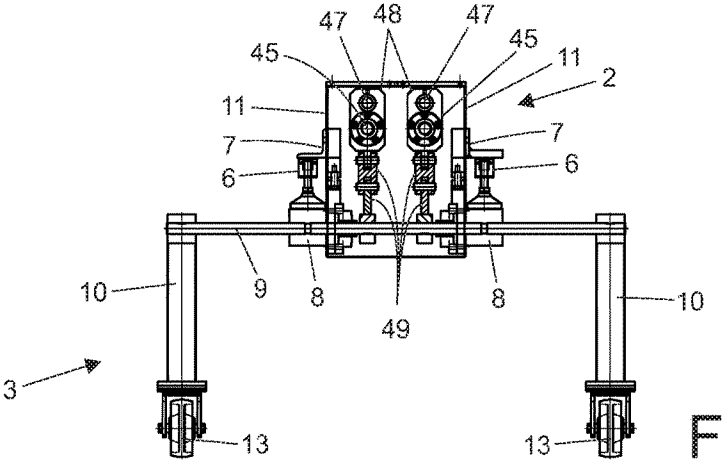
Figure 7:
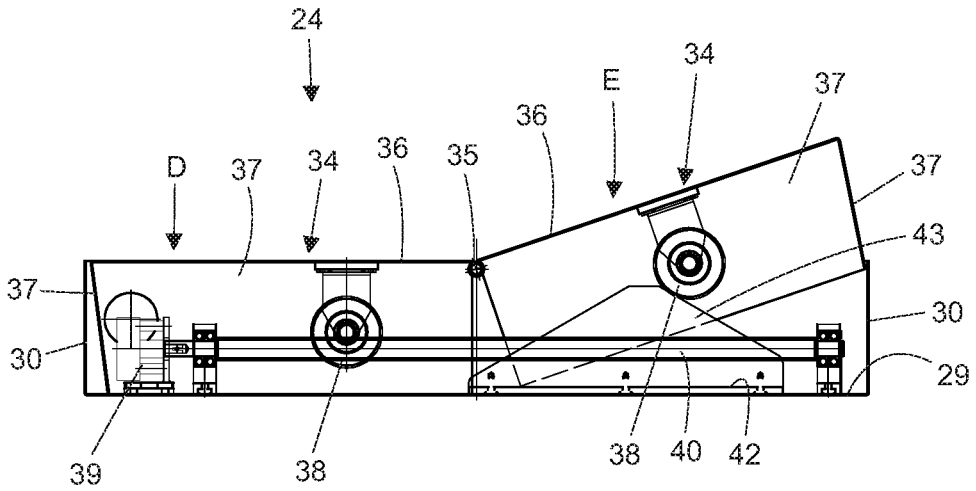
Figure 8:
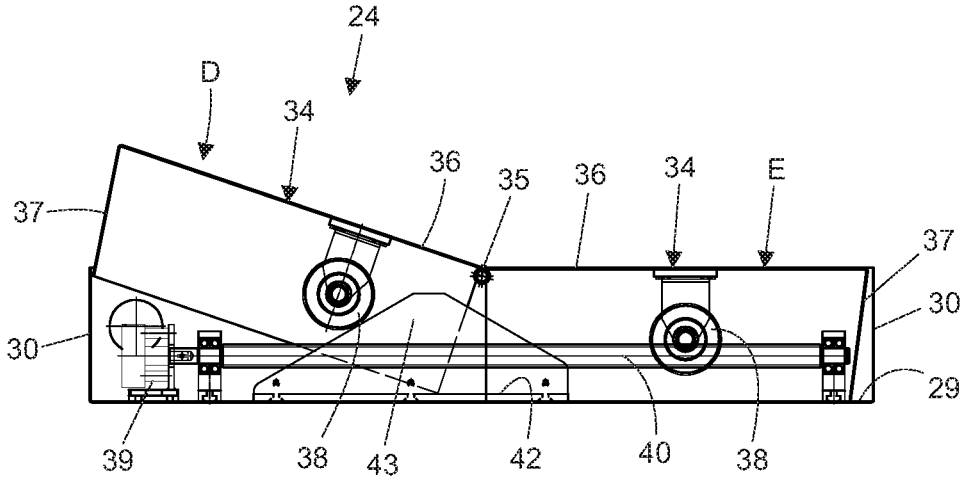
Figure 10:
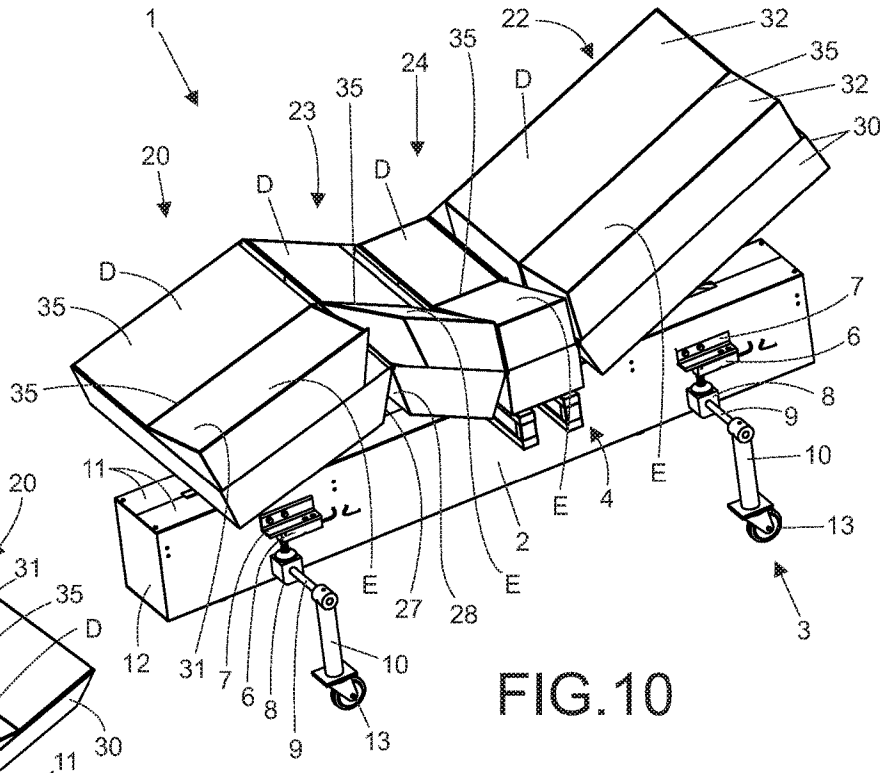
Figure 9:
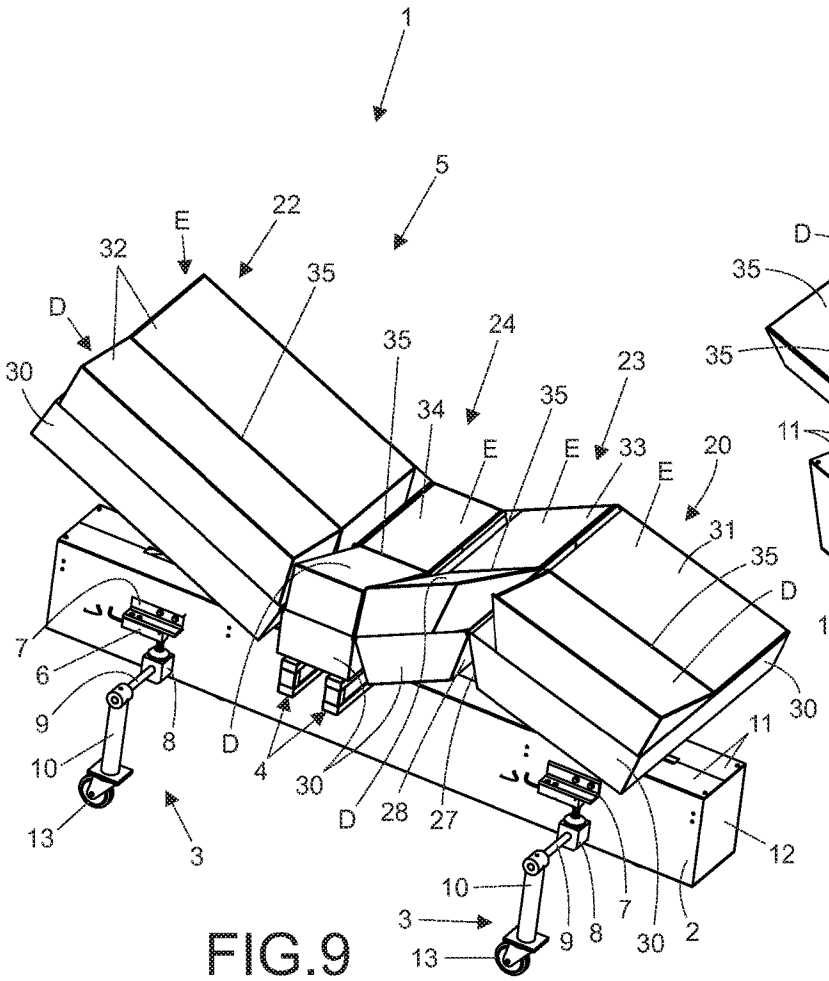
Figure 11:
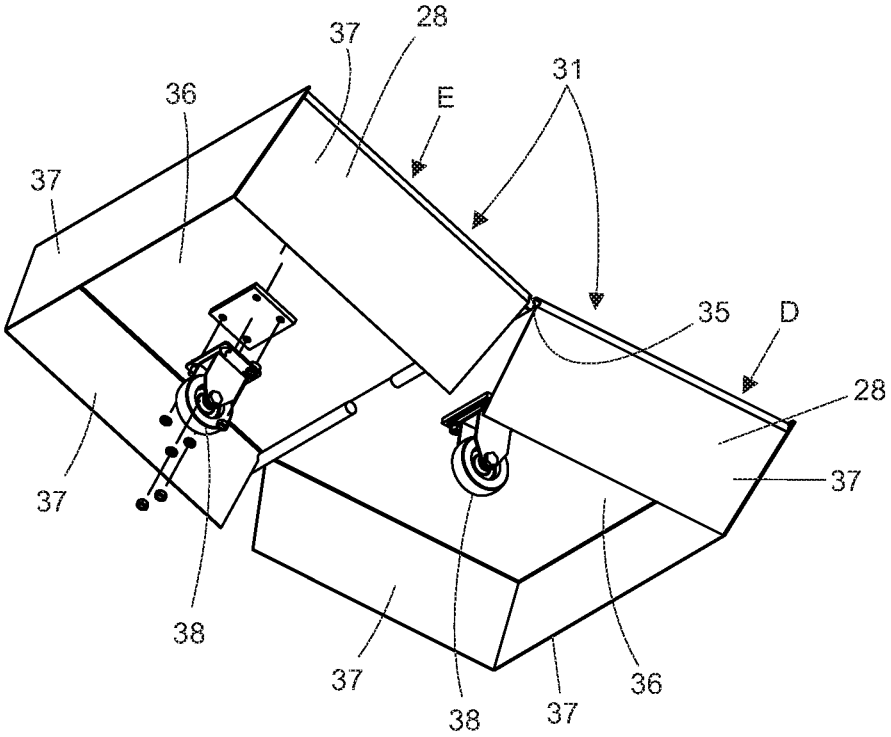
Figure 12:
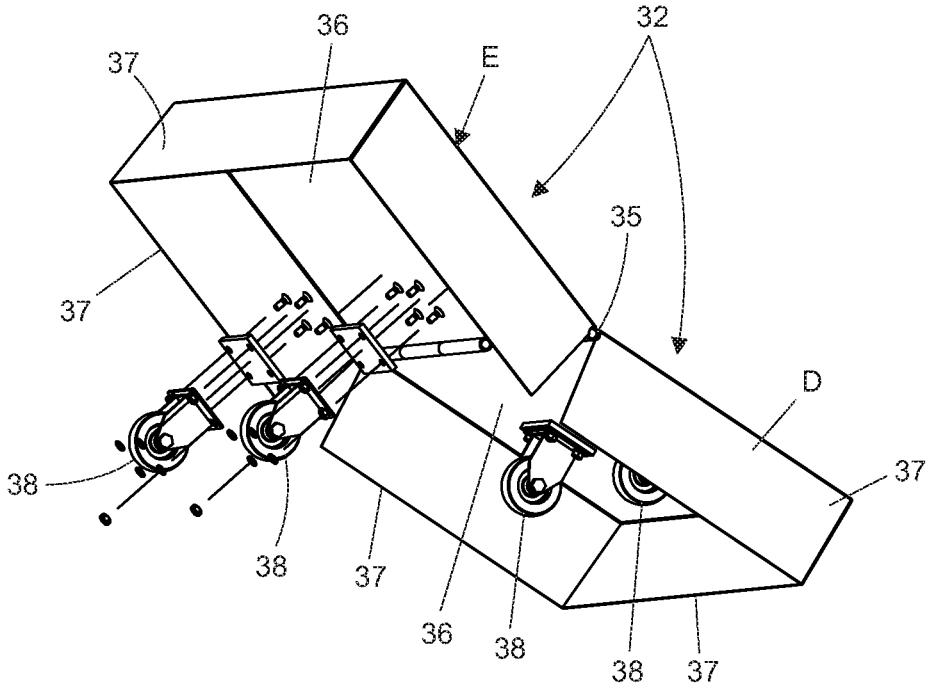
Figure 13:
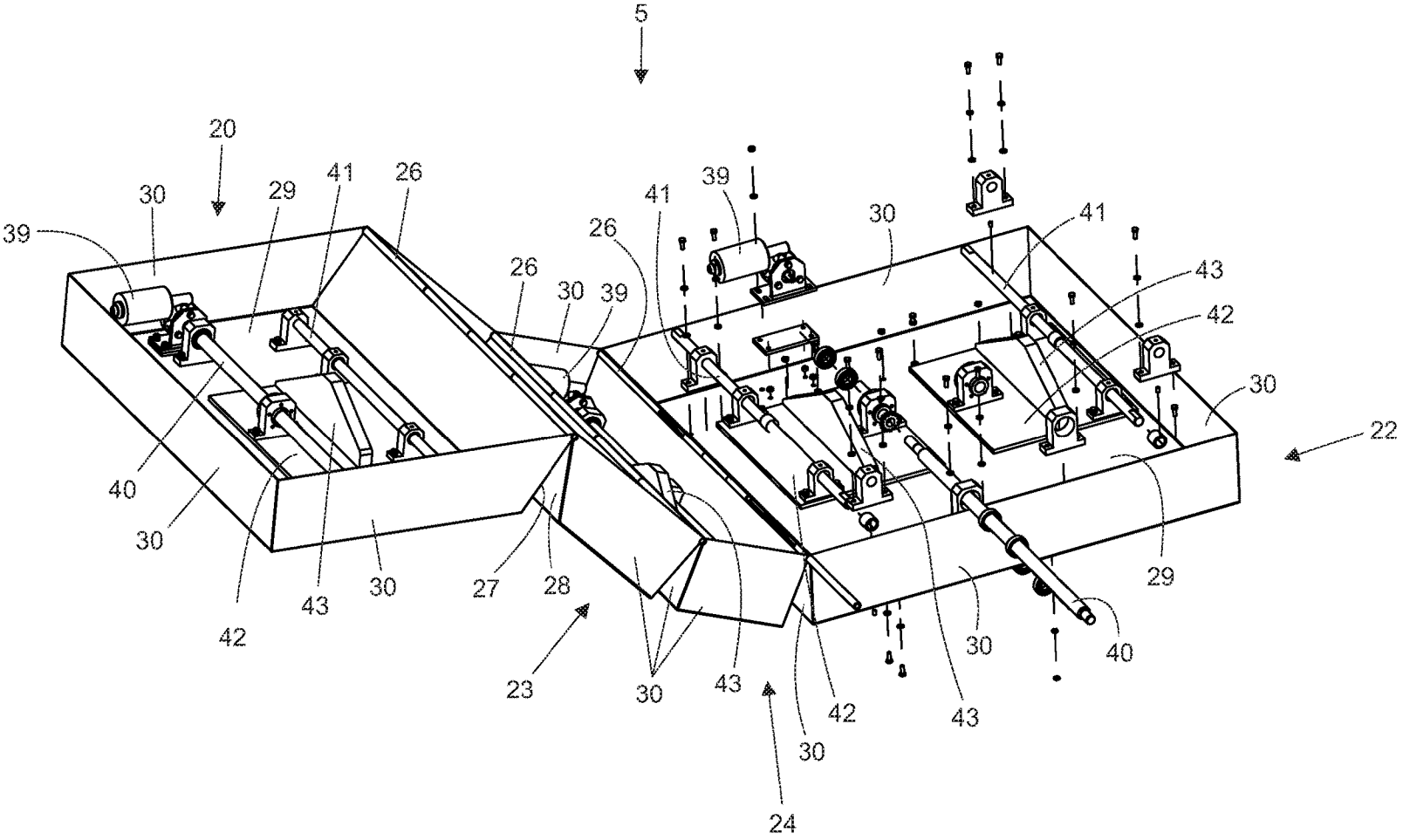
Figure 14:
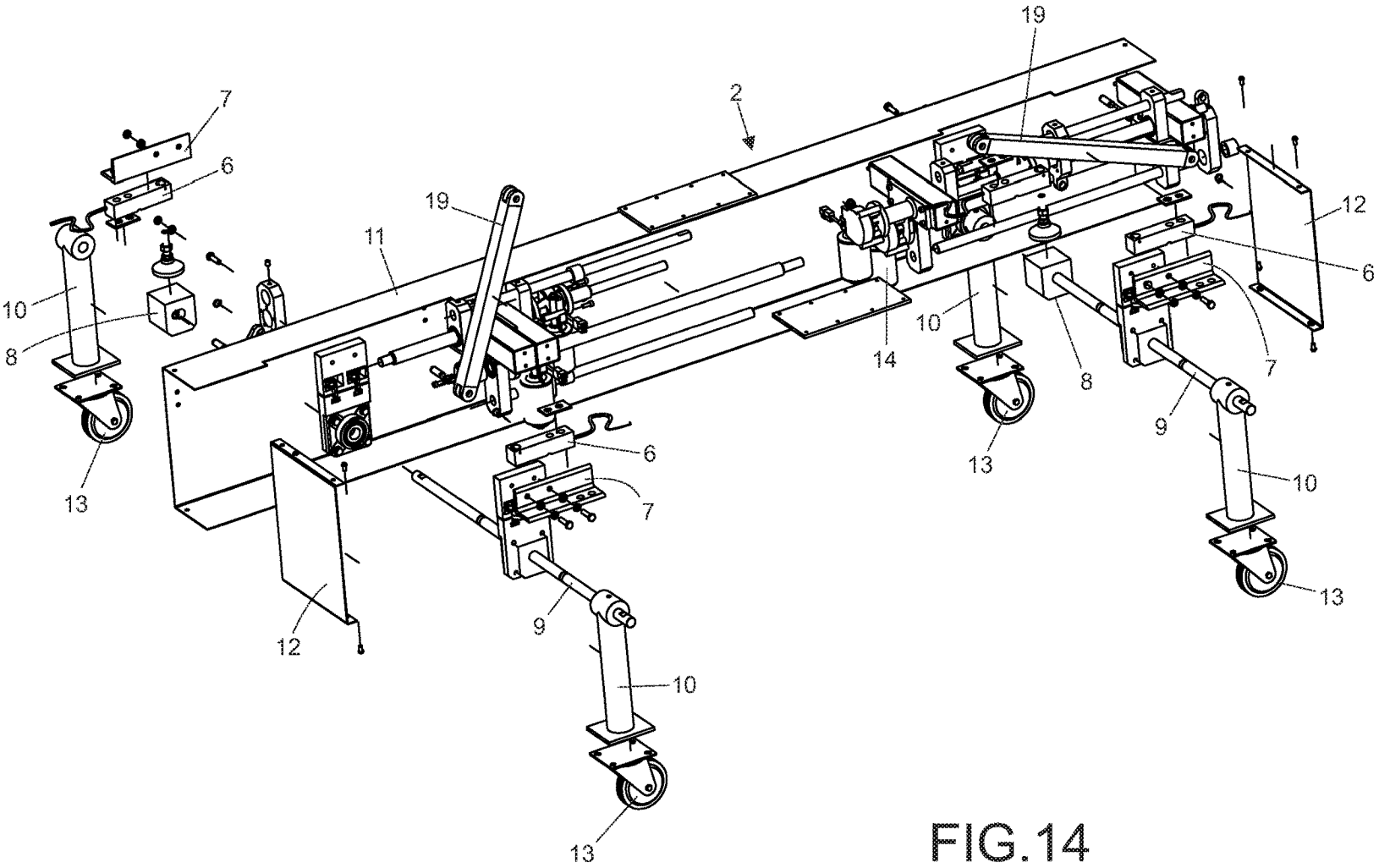

FIG. 4 shows a side view of the hospital bed structure, wherein its lower bed is depicted in order to demonstrate the raising movements of the planes for supporting the back, in order to demonstrate the angular movement of the covers, which are mounted on the lower bed stage, for the thighs and legs of the patient; said figure illustrates simultaneously the lower bed frame in fully horizontal position and on its point of maximal movement;

FIG. 5 illustrates a side and schematic view of the frame box, depicting the lifting movement of the bedposts of the hospital bed structure, as herein shown; said figure illustrates simultaneously the bedposts in the vertical position and in two retraction stages;

FIG. 6 illustrates a cross-section of the frame box depicting one of the bedpost sets of the hospital bed structure as herein shown and allowing the visualization of the positioning of two of the load cells;

FIG. 7 illustrates schematically the angular lifting movement of the covers of two of the support planes of the hospital bed structure concerned, wherein it can be seen a first ramp profile serving as reference for the execution of this movement;

FIG. 8 illustrates schematically the angular lifting movement of the covers of two of the support planes of the hospital bed structure concerned, wherein it can be seen a second ramp profile serving as reference for the execution of this movement;

FIG. 9 shows the hospital bed structure as herein shown, wherein the support planes of the lower bed frame are moved longitudinally, which determines the lifting of the planes for supporting backrest/thigh/legs, as well as in the direction of angular lifting of the right and left portions of their respective covers, which alternately determines the lateral lifting of the planes for supporting backrests/hips/thighs/legs, on the right set FIG. 10 shows the hospital bed structure as herein shown, wherein the support planes of the lower bed frame are moved longitudinally, which determines the lifting of the planes for supporting backrest/thigh/legs, as well as in the direction of angular lifting of the right and left portions of their respective covers, which alternately determines the lateral lifting of the planes for supporting backrests/hips/thighs/legs, on the left set;

FIG. 11 shows, separately, and in lower view, the covers of the plane for supporting the thigs, with one of its casters seen in exploded view;

FIG. 12 illustrates, separately, and in lower view the covers of the plane for supporting the backrest, with two of its casters seen in exploded view;

FIG. 13 shows an perspective view, separately, of the lower bed frame of the hospital bed structure as herein disclosed, with some of its components in exploded view; and FIG. 14 illustrates an exploded perspective view of the frame box defining the control tunnel of the hospital bed structure as herein disclosed.

DETAILED DESCRIPTION

The hospital bed structure is identified through the reference signal 1 and is defined by four main elements, the first of which is a frame box 2, which has two sets of bedposts 3, being one front and one rear; The second of which is the supporting frame 4, which is mounted on and transversally to the frame box 2; The third of them is the lower bed frame 5; And the fourth of them is the load cells 6 which are mounted between bearing profiles 7 fixed to the side of the frame box and the blocks 8 through which the axles 9 pass, at the end of which are mounted the tubes 10, which together with the respective casters 13 define structures of the bedpost sets 3.

The frame box 2 is formed by two "C" profiles 11 mounted against each other, wherein at the two ends of the pair of profiles 11 a closure panel 12 is mounted.

The frame box 2 houses in its interior the mechanisms for actuating the planes of the lower bed frame 5 as well as of the bedpost sets 3 therein.

The mechanisms for actuating the planes of the planes of the lower bed frame 5 comprise, respectively, a reducer motor 14, a spindle 15, a circular nut 16, and a linear guide 17, both the spindle 15 and the linear guide 17 being mounted in Brackets 18, in which one of the brackets 18 is also mounted the reducer motor 14.

The mechanisms for actuating the planes of the lower bed frame 5 further comprise two movement bars 19, one of which moving the leg support plane 20 of the lower bed frame 5, the corresponding movement bar 19 being hingedly mounted between the circular nut 16 and the lower joint 21 of the said leg support plane 20. The other movement bar 19 is used to promote movement of the backrest plane 22.

The movement of the leg support plane 20 causes the thigs support plane 20 to move simultaneously, since the leg support plane 20 is pivotally attached to the support plane for the thigs 23, which, in turn, is also fixed, in an articulated manner, with respect to the support plane for the thigs 24.

The support plane for the hips 24 is rigidly fixed to the support frame 4, which, in turn, is, as already mentioned, fixed directly on the structural housing 2.

The movement of the support plane for the backrest 22 occurs relative to the support plane for the hip 24, since said plane for the backrest 22 is hingedly mounted on the support plane for the hip 24, the movement bar 19 being mounted between the circular nut 16 and the lower joint 25 arranged under the support plane for the backrest 22.

Figure 1:
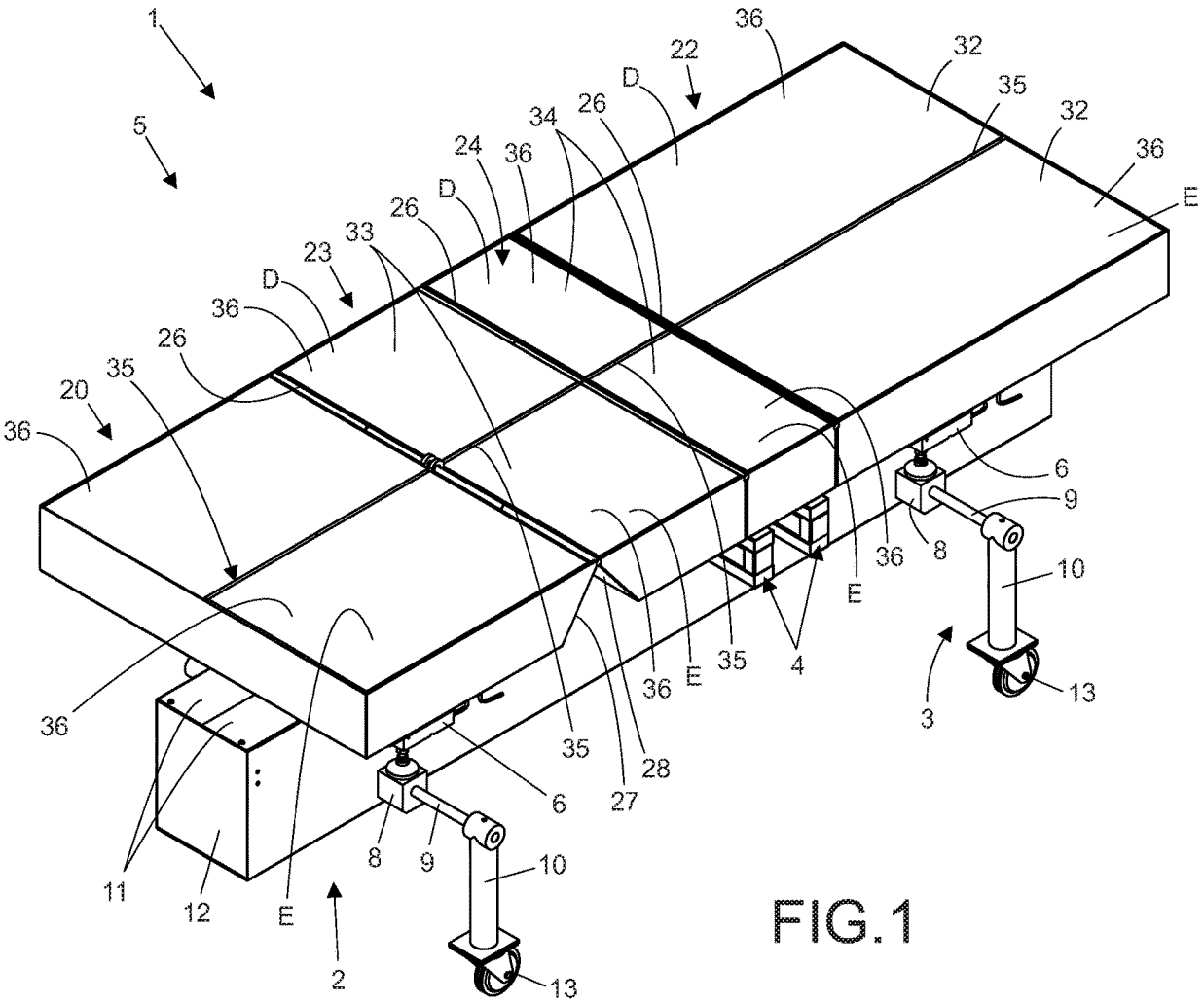
FIG. 1 shows a perspective view of the hospital bed structure proposed herein, whose support planes are horizontally arranged, wherein in said figure there can be seen the frame box, its legs and on the frame box is arranged the lower bed frame.
Figure 2:
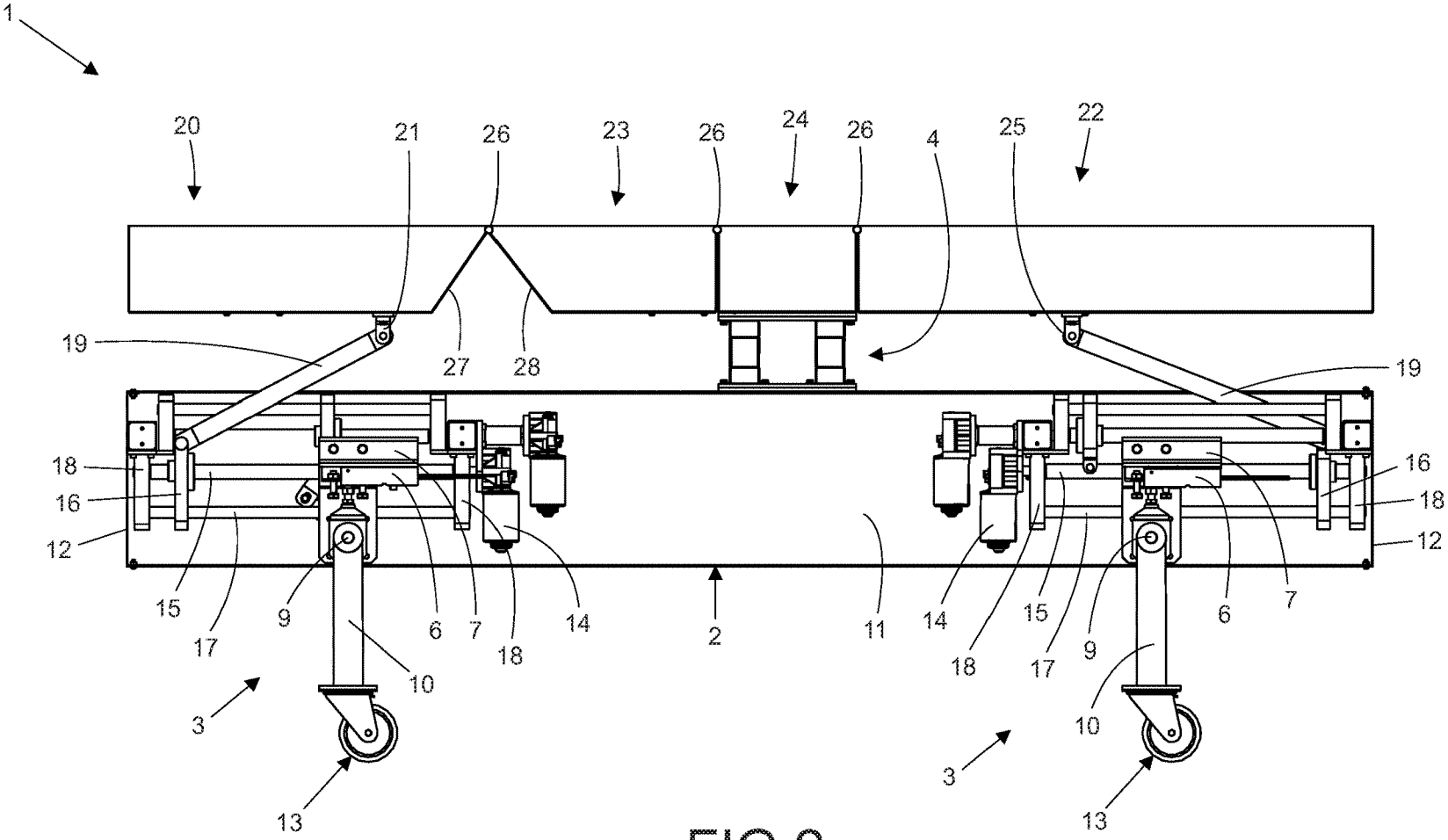
FIG. 2 shows a side and schematic view of the hospital bed structure as herein shown.
Figure 3:
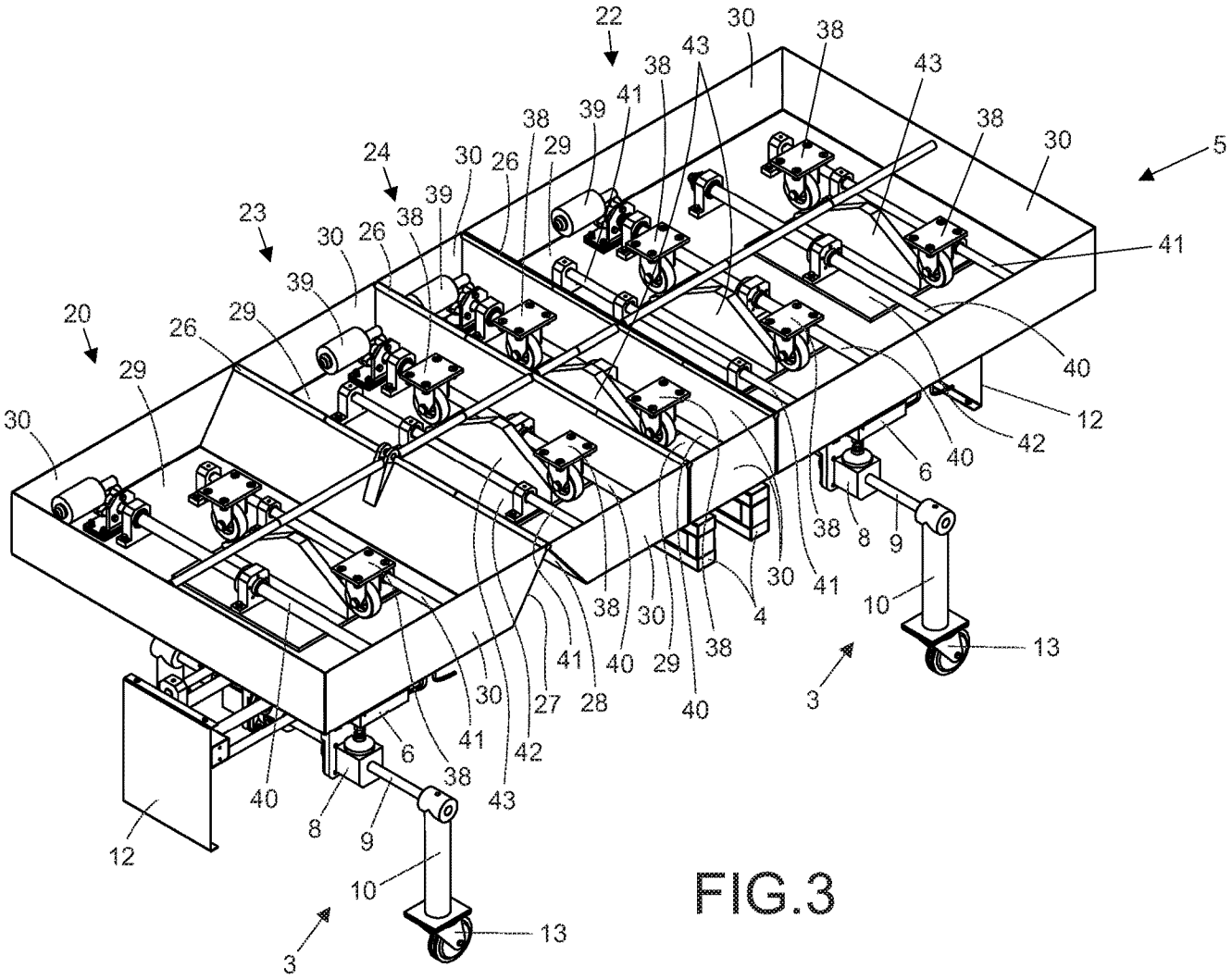
FIG. 3 shows a perspective view of the hospital bed structure that is illustrated in order to depict the mechanisms allowing the angular movement of the covers mounted on the lower bed frame.

The support planes 20, 22, 23 and 24 are shown in FIG. 2 in fully horizontal position, thus showing the initial position of the lower bed frame 5.

In the same FIG. 5 it can be seen that the support planes 20, 22, 23*e* 24 are hingedly attached by hinge-like assemblies 26, said assemblies 26 being arranged transversely to the direction of length of the hospital bed structure 1 and positioned at the upper edge of each of the planes 20, 22, 23 and 24.

Still in relation to the same FIG. 20, it can be seen that the opposite faces of the planes for supporting the legs 20 and for the thighs 23 each have a bevelled cut, the bevel cut of the plane for supporting the legs 20 being indicated by the reference numeral 27 and the bevelled cut of the plane for supporting the thighs 23 indicated by the reference numeral 28.

The bevelled cuts 27*e* 28 of the planes for supporting the legs 20 and the thighs 23 allow said support planes to execute the lifting movement, as shown in FIGS. 4, 9, 10 and 13.

The planes for supporting the legs 20, the thighs 23, the hips 24 and the backrest 22 are similar in construction to boxes each having bottom walls 29 and vertical surrounding walls 30.

In each of the planes for supporting the legs 20, the thighs 23, the hips 24 and the backrest 22 are mounted the corresponding covers 31, 32, 33 and 34.

The covers 31, 32, 33 and 34 each include a right portion D and a left portion E, both joined by hinge-like assemblies 35, said assemblies 35 being disposed longitudinally with respect to the length direction of the hospital bed structure 1 and positioned in the upper limit of each of the left and right portions of the covers 31, 32, 33 and 34.

The right and left portions E of the covers 31, 32, 33 and 34 each have an upper wall 36 and side walls 37, with casters 38 being mounted on the lower face of the upper wall 36.

The right and left portions D and E of each of the covers 31, 32, 33 and 34 are moved angularly relative to each other, this movement occurring by the action of the mechanisms which are mounted within each of the respective support of the legs 20, thighs 23, hips 24 and the backrest 22.

The respective mechanisms for moving the covers 31, 32, 33 and 34 can be seen particularly in FIGS. 3, 7, 8 and 13 and are composed of the following main components: a reducer motor 39, a spindle 40, a linear guide 41 and a movable plate 42, provided with a dual ramp profile 43.

The reducer motors 39, in simultaneous movement, are driven to rotate the respective spindles 40, thereby causing lateral movement of the movable plate 42.

As the respective casters 38 of the right portion D and left portion E of the covers 31, 32, 33 and 34 are supported against the double ramp profile 43, with the movement of the movable plates 42 causing the angular movement of the right portion D and left portion E of each of the covers 31, 32 and 33.

This moving effect can be better understood by observing FIGS. 7 and 8, where in FIG. 7, the movable plate 42 sometimes advances in the direction of the left portion E causing its upward angular movement (FIG. 7), and sometimes it advances in the direction of the right portion D causing its angular upward movement (FIG. 8). In this movement from one side to the other, the movable plate 42 retains its position thanks to the linear guide 41.

With respect to the bedposts 3, and as is seen with respect to the mechanisms for driving the planes of the lower bed frame 5, their drive mechanisms are also mounted within the frame box 2, as best seen in FIGS. 5 and 6.

The drive mechanisms of the bedposts 3 comprise, respectively, a reducer motor 44, a spindle 45, a circular nut 46, and a linear guide 47, both spindle 45 and linear guide 47 being mounted on supports 48, and in that one of the supports 48 is also mounted the reducer motor 44.

The drive mechanisms of the bedposts 3 further comprise two hinged bars 49, which directly move the axis 9 of each of the bedpost sets 3.

FIG. 5 depicts the bedpost sets 3 in three stages, wherein the first stage is represented by the bedposts 3 in an upright position, and the other stages comprise the bedposts 3 at two retraction points.

The movement of the bedposts 3 allows the overall height of the hospital bed structure 1 to be adjusted, where the highest height corresponds to the vertical positioning of the bedposts 3 and the smaller height corresponds to the bedposts and in a greater retraction stage.

The invention claimed is:

1. A hospital bed structure comprising:

a frame box, which has two sets of bedposts comprising a front set and a rear set;

a support frame, which is mounted on, and disposed transversely, to the frame box;

a lower bed frame coupled to the support frame;

a plurality of load cells mounted between (a) bearing profiles that are fixed to a side of the frame box and (b) blocks through which a portion of an axle is passed, and a mounted tube having a caster is coupled to an end of the axle, which collectively define a structure of each of the two sets of bedposts;

wherein the frame box comprises two "C" shaped pieces mounted against one another, and a closure panel being mounted at both ends of the two "C" shaped pieces;

wherein the frame box houses drive mechanisms of platforms of the lower bed frame and the two sets of bedposts, the drive mechanisms for moving the platforms of the lower bed frame comprise, respectively, a reducer motor, a spindle, a circular nut, and a linear guide, wherein the spindle and the linear guide are each mounted on supports, and further wherein one of the supports is mounted on the reducer motor;

wherein the drive mechanisms for actuating the platforms of the lower bed frame further comprise first and second movement bars, where the first movement bar is configured to move a first support platform configured to support a patient's, and where the second movement bar is hingedly mounted between the circular nut and a lower joint of the first support platform, and where the second movement bar is configured to cause movement of a second support platform configured to support a back of the patient, such that the movement of the first support platform causes simultaneous movement of a third support platform configured to support thighs of the patient, and wherein the third support platform is pivotally attached to a forth support platform configured to support hips of the patient, wherein the forth support platform is rigidly attached to the support frame that is fixed directly on the frame box, wherein the second support platform is hingedly mounted to the forth support platform, such that the movement of the second support platform is related to movement of the forth support platform;

wherein the second movement bar is mounted between the circular nut and the lower joint provided under the second support platform, and the first, second, third and fourth support planes are hingedly attached by hinge assemblies which are arranged transversally to a length direction of the hospital bed frame and positioned at an upper limit of each of the planes;

wherein the first and third support platforms each has a bevelled cut.

2. The hospital bed structure according to claim 1, wherein the bevelled cut of the first and third support platforms enable the first and third support platforms to provide lifting movement; wherein the first, second, third and fourth support platforms each comprises bottom walls and vertical surrounding walls; wherein on each of the first, second, third and fourth support platforms are mounted corresponding covers that each includes a right portion joined by hinged assemblies to a left portion, the hinge assemblies disposed longitudinally in relative to a length direction of the hospital bed structure and positioned at the upper limit of each of the left and right portions of the covers; wherein the right portions and left portions of the covers each has each has an upper wall and side walls, and wherein on a lower face of the upper wall of the covers is mounted on the casters; the left and right portions of each of the covers are configured to move angularly relative to each other, with such movement caused by the action of the drive mechanisms mounted within each of the respective first, second, third and fourth support platforms.

3. The hospital bed structure according to claim 2, wherein the drive mechanisms for moving the covers are composed of:

a reducer motor, a spindle, linear guide and a movable plate, provided with a double ramp profile; and wherein the reducer motor causes rotation of the respective spindle, thereby causing lateral movement of a movable plate.

4. The hospital bed structure according to claim 2, wherein the respective casters of the right and left portions of the covers are supported against the double ramp profile, such that movement of movable plates coupled with the spindle causes angular movement of the right and left portions of each of the covers.

5. The hospital bed structure according to claim 1, wherein drive mechanisms of the two sets of bedposts are mounted inside of the frame box; wherein the drive mechanisms for driving the two sets of bedposts comprise, respectively, a reducer motor, a spindle, a circular nut, and a linear guide, wherein the spindle and the linear guide are mounted on supports, wherein the reducer motor is mounted on one of the supports; wherein the drive mechanisms for driving the two sets of bedposts further comprise two hinged bars which directly move an axle of each of the two sets of bedposts sets, such that movement of the two sets of bedposts adjust an overall height of the hospital bed structure, where a maximum height corresponds to a vertical positioning of the two sets of bedposts and a minimum height corresponds to the two sets of bedposts in a retraction stage.

* * * * *